United States Patent [19]

Sargent

[11] 4,183,184

[45] Jan. 15, 1980

[54] AIR-SUPPORTED SHELTER SYSTEM

[76] Inventor: Clarence Sargent, 153 McClellan Ave., San Mateo, Calif. 94403

[21] Appl. No.: 934,798

[22] Filed: Aug. 18, 1978

[51] Int. Cl.[2] ..... E04B 1/345

[52] U.S. Cl. ..... 52/2; 135/15 PE

[58] Field of Search ..... 52/2, 155; 135/1, 15PE

[56] References Cited

U.S. PATENT DOCUMENTS

| | | | |
|---|---|---|---|
| 3,159,165 | 12/1964 | Cohen et al. | 52/2 X |
| 3,353,309 | 11/1967 | Kwake | 52/2 |
| 3,496,686 | 2/1970 | Bird | 52/2 |
| 3,651,609 | 3/1972 | Bird | 52/2 |
| 3,728,831 | 4/1973 | Bird | 52/2 |

FOREIGN PATENT DOCUMENTS

| | | | |
|---|---|---|---|
| 1503509 | 3/1978 | United Kingdom | 52/2 |

*Primary Examiner*—J. Karl Bell

*Attorney, Agent, or Firm*—T. R. Zegree

[57] ABSTRACT

An air-supported shelter for covering swimming pools, warehousing, greenhouses, recreation areas, climate control, pouring cement foundations and the like uses. The shelter system includes an inflatable enclosure and a blower assembly for inflation thereof. The enclosure is attached to a base by a plurality of anchors which hold a cable disposed in a hem forming the lower portion of the enclosure. The cable is connected to a tautening device by means of which an air-tight seal between the enclosure and the base is attained. The entire shelter system with the enclosure in collapsed state may be placed in a housing for storage or shipping purposes.

9 Claims, 6 Drawing Figures

AIR-SUPPORTED SHELTER SYSTEM

BACKGROUND OF THE INVENTION

The present invention relates generally to improvements in air-supported shelters and more particularly to inflatable shelters which provide an enclosure for an area thus shielding it against elements and assuring comfort and pleasant environment.

Various types of air-supported shelters are presently known or have been described in patent literature. The closest prior art known to the applicant is that of the U.S. Pat. No. 3,159,165 which discloses an air-supported structure including a door for entering and leaving the enclosure and a blower mechanism, both of which are separate from the sheet of the enclosure. The base of the enclosure which extends along the ground over the blower outlet and over the door frame includes a sleeve with an elongated cable mounted within the passage thereof. The cable is fastened to the ground by hook fasteners which are screwed into fittings embedded in the apron. Another cable extending around the door frame and anchored to the ground is provided to insure that the door frame is held solidly in place. An air seal is provided along the base by a flap which rests on the ground or follows the contour of the door and other equipment placed under the sleeve. Such structure has a few drawbacks. For instance, a separate door has to be installed with special care to avoid air leakage and is difficult to disassemble. The hook fasteners are hazardous when left screwed into fittings embedded in the concrete base. If it is desired to remove them, such operation is tedious and time consuming. The flap must be specially designed to fit the outline of the door frame, of the blower outlet or the like equipment.

U.S. Pat. No. 3,353,309 describes an inflatable structure, the lower edge of which is formed of a tubular rim filled with water to provide a sealing contact with the deck. Several parallel strips extending across the ceiling portion of the enclosure are attached to the deck by pins embedded therein. Water-filled tubes have been found disadvantageous as they frequently develop leaks which necessitate repairs, are awkward and time-consuming to be emptied or refilled with water when assembling or disassembling the structure and are adversely affected by formation of algae or mildew.

U.S. Pat. No. 3,651,609 shows an air-inflated structure formed by a number of horizontally elongated panels joined together and a reinforcing cable system comprising parallel tensioning cables connected at their ends to ground anchors.

U.S. Pat. No. 3,728,831 discloses a similar air-inflated structure including parallel tension devices connected to tension transmitting cables running lengthwise of the central section of the structure. Such reinforcing cables are not only costly but, in addition, render the structure difficult to assemble and disassemble.

An inflatable shelter having a metallic track permanently secured to the decking for affixing the bottom edge of the shelter around a swimming pool is also known. A drawback of such an installation is that people walking or children playing on the deck may trip over the track and suffer an injury.

Rigid enclosures are likewise known for use in covering swimming pools. However, such enclosures are cumbersome in that not only they are difficult to be removed in hot weather when they are not needed, but they also require a large area for storage when not in use.

The various drawbacks and disadvantages of the prior art structures discussed hereinabove can be overcome by the provision of an improved air-supported shelter system described in detail hereinafter.

OBJECTS AND SUMMARY OF THE INVENTION

Accordingly, it is the main object of this invention to provide an air-supported shelter system having an inflatable enclosure which is held secured to the ground by especially designed and easily installed or removed anchoring devices.

Another object of this invention is the provision of an inflatable shelter which includes a cable extending throughout its periphery adjacent to the ground, the cable being maintained taut while the shelter is inflated to assure an air-sealing contact between the lower edge of the shelter and the ground.

A further object of the present invention is to provide a weather-resistant inflatable shelter which can easily be erected or disassembled in a matter of minutes.

A still further object of this invention is to provide an inflatable shelter which can be stored and easily transported when not in use together with all its accessories in a relatively small housing unit.

An even further object of the invention is the provision of an air-supported shelter which can be manufactured at a low cost from readily available materials to cover a small or a large area and shield it from inclement or cold weather and snow.

These and other objects of this invention will become more fully apparent from the following description taken in conjunction with the accompanying drawing.

In accordance with the preferred embodiment of the present invention an air-supported shelter system comprises, in combination, an inflatable enclosure attached to a base along the periphery of the enclosure. The enclosure has a relatively narrow integral hem at its lower portion and the peripheral edge of the enclosure is adapted to be in air-sealing contact with the base. A flexible cable extending within the hem provides a connection with anchoring means which releasably attach the enclosure to the base. The anchoring means includes a plurality of corner anchors and side anchors, both types of anchors being slidably insertable into openings in the base. A cable tautening means is provided for holding the periphery of the enclosure firmly in contact with the base, whereby loss or leakage of air from under the enclosure is substantially prevented. A blower assembly for inflating the enclosure is installed nearby to insure that the enclosure is maintained in inflated form while in use.

BRIEF DESCRIPTION OF THE DRAWING

The invention will now be more fully described with reference to the accompanying drawing wherein.

DETAILED DESCRIPTION

Figure 1:
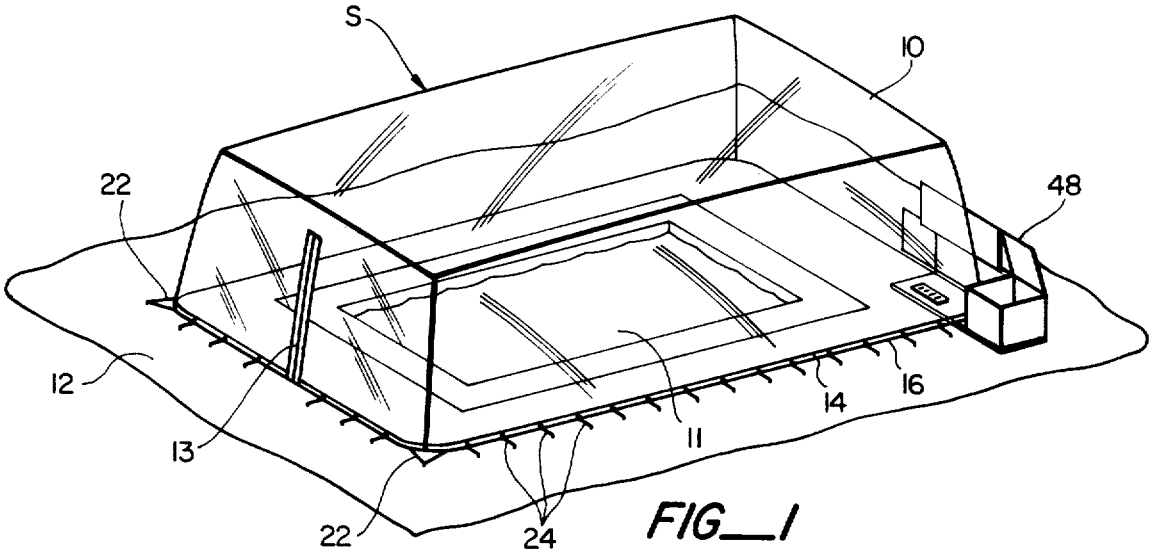
FIG. 1 is a perspective view of one embodiment of the invention showing an inflated enclosure covering a swimming pool with anchors disposed around the pool for securing the cable extending in the lower portion of the enclosure to the base and also showing a housing for auxiliary accessories and equipment for the enclosure.

Referring now to FIG. 1 of the drawing, wherein similar reference characters designate corresponding elements, an air-supported shelter system S is illustrated with an enclosure 10 in its inflated position over a swimming pool 11 which is surrounded by a deck or base 12. The shelter system 6 is comprised of an inflatable enclosure 10 preferably made of a single piece of a light weight, flexible, water-repellent and substantially non-porous sheet material, such as a plastic, for example a vinyl or polyethylene film, a rubberized fabric or a coated fabric, such as polyurethane-coated polyester and the like. The enclosure 10 is provided with an entrance formed of a heavy duty zipper 13 for access in and out of the enclosed area. The zipper 13 is fastened to the edges of a slit made in the enclosure 10 by a seam or any other suitable method in such a manner that an air-tight seal between the zipper 13 and the material of the enclosure 10 is assured. A relatively narrow, integral hem 14 forms the lower peripheral portion of the enclosure 10. Such hem may conveniently be made by folding over a short bottom portion of the enclosure 10 and stitching its edge to the body of the enclosure thus forming a passage around the entire periphery of the enclosure 10 for a cable which will be referred to hereinafter.

While the ceiling portion of the enclosure 10, when inflated as shown in FIG. 1, is of a substantially arcuate shape and has a rectangular floor plan, it will be understood that enclosures of various curved configurations and triangular or polygonal floor plans are within the scope of this invention.

As previously mentioned, a highly suitable sheet material for use in the manufacture of the enclosure 10 is a polyurethane-coated water-repellent polyester fabric of relatively light weight, such as from about 4 to 10 ounces per square yard for an enclosure covering a swimming pool having a size of 20 by 40 feet. Heavier sheet materials may be employed, however, for larger size installations. A suitable resinous surface coating of the sheet material imparts not only water repellency thereto but improves durability of the sheet material by inhibiting its deterioration due to weathering.

The lower edge 16 of the hem 14 is maintained in sealing contact with the base 12 by a cable 18 which is encased within the hem around the entire periphery of the enclosure 10 with its both ends extending outside of the hem to be secured within the housing 48 as will be explained hereinafter. Although it is preferred herein to employ a metallic cable of adequate thickness and strength to withstand tension exerted by the inflated enclosure in a given installation, a rope made from any other flexible, relatively non-stretchable material, such as polyester fiber, nylon or fiberglass is satisfactory for use in the hem 14 of enclosure 10.

Figure 2:
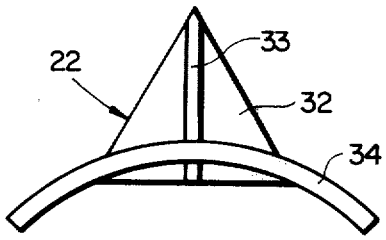
FIG. 2 is a top plan view of one of the corner anchors.
Figure 3:
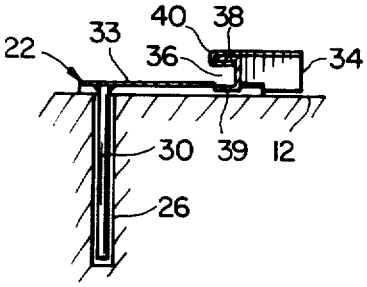
FIG. 3 is a cross-sectional view of the corner anchor shown in FIG. 2 when inserted into an opening in the base.
Figure 4:
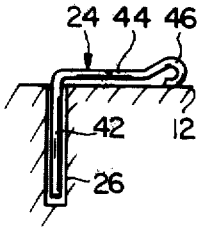
FIG. 4 is a cross-sectional view of one of the side anchors also inserted in the opening in the base.

The enclosure 10 is firmly attached to the base 12 when inflated by the blower 20 and it is maintained in air-sealing contact with the base 12 by anchoring means which are disposed exteriorly of the shelter and are comprised of corner anchors 22 shown in detail in FIGS. 2 and 3 and side anchors 24 shown in FIG. 4. The anchors are adapted to be in releasable contact with the cable 18, each of the anchors being slidably insertable in vertical longitudinal openings 26 provided around the perimeter of the base 12.

As illustrated in FIG. 1, the corner anchors 22 are arranged in four corners of the enclosure 10, three anchors being inserted in predrilled holes in the pool deck or base 12 and one anchor being affixed in a suitable manner in the housing 48. The corner anchors 22 which are positioned in the openings 26 made in the base 12 are comprised of a longitudinal rod 30 of cylindrical shape whose diameter is somewhat smaller than that of the openings 26 to insure an easy insertion and removal of the anchors 22 to and from the openings 26. One end of the rod 30 is affixed by welding or any other convenient manner to a plate 32 at a substantially right angle to the plane of the plate 32. The plate 32 is preferably made of a sheet metal and has a triangular configuration to provide reinforcement for the anchor and thus prevent the anchor from bending under pressure and stress exerted by the inflated shelter. The plate 32 has a central groove extending from its apex to the center of its base, the opposite side of the plate 32 having a corresponding longitudinal protrusion 33, as shown in FIG. 2. One end of the rod 30 extends into the groove of the plate 32 and is secured therein by welding or any other suitable means. It should be noted that when a corner anchor 22 is mounted in the housing 48, the rod 30 is not required and the anchor 22 may be affixed to the housing 48 by securing the plate 32 to the floor of the housing with any suitable fastening means, such as nuts and bolts. A curved flange 34 is joined to the plate 32 adjacent to its base by welding or any other suitable means, a small portion of the protrusion 33 is cut out to accommodate the portion of the flange 34 crossing it so that the flange is positioned flat on the surface of the plate 32. The outwardly extending curved flange 34 has a U-shaped recess throughout its length, the recess 36 forming a track for receiving the cable 18. The flange 34 is comprised of an upper lip 38 and a lower lip 39, a portion of the bottom surface of the lower lip contacting the surface of the plate 32. The upper lip 38 is covered preferably with a protective strip 40 of a resilient material, such as rubber, vinyl or the like to prevent a direct contact between the edge of the lip 38 and the sheet material of enclosure 10 thus preventing possible tearing of such material which is placed under stress when enclosure 10 is fully inflated and anchored to the base 12. The corner anchors 22 provide a means of holding portions of the enclosure 10 adjacent to the corners in a smooth configuration thus eliminating stress points commonly occurring in air-supported structures of the prior art.

The side anchors 24 which are disposed around the perimeter of a swimming pool or any other area to be sheltered are substantially L-shaped and include a cylindrical rod 42 slidably insertable into a vertical longitudinal opening 26 in the base 12, such opening being of a diameter slightly larger than that of the rod 42 so that each side anchor 24 can be readily inserted or removed manually into or from the opening 26. As shown in FIG. 4, the side anchor 24 comprises an arm 44, the free end of which is of a hook-like shape 46 adapted to receive and hold cable 18. The side anchors 24 are spaced apart from each other a distance sufficient to insure that cable 18 held by them under tension causes the lower edge of the enclosure 10 to be in firm, air-tight contact with the surface of the base 12. Such contact is provided by a conventional narrow strip of sheet material forming a part of enclosure 10 and disposed interiorly thereof along its perimeter, whereby the air pressure maintained inside the enclosure 10 causes the free end portion of the strip to adhere to the base 12. For example, in a swimming pool of 20 by 40 feet size, the side anchors 24 may be spaced about 3 feet apart when the surface of base 12 is rough and about 4–5 feet apart when its surface is smooth. In general, the spacing between the side anchors around the area to be enclosed is dependent on the size and configuration of the specific enclosure, the criterion being that a substantially air-tight seal between the enclosure 10 and the surface of base 12 must be provided. As stated earlier, both types of anchors are slidably insertable into the openings 26 in the base 12 and held firmly therein merely by the tension conditions exerted by the cable 18 maintained tightly stretched by the tautening means 28.

In some instances where a piece of equipment or any object is placed under the edge 16 of the enclosure 10, the hem 14 may have to be partially tailored to fit the contour of such object and in such case it may be desirable to install one or more additional side anchors to prevent escape of internal air under pressure from the inflated enclosure 10.

When a new enclosure 10 is initially installed, small holes or slits are usually made in the hem 14 to enable the hooks 46 to enter inside the hem for engagement with the cable 18. Such small openings in the hem are, of course, aligned with each of the side anchors throughout the periphery of the enclosure 10.

Figure 5:
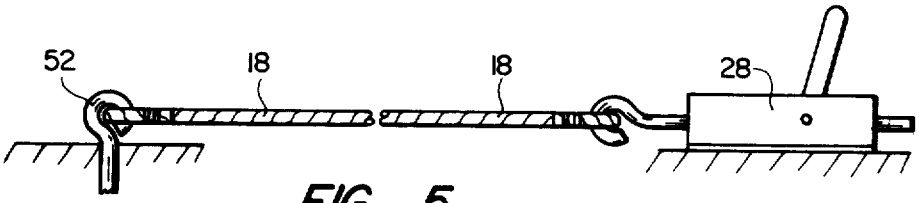
FIG. 5 is a diagrammatic representation of the tautening means showing one end of the cable affixed thereto, the other end of the cable being secured to a fastener device mounted in the base or a wall of a housing, the cable being broken away.

It is an important feature of this invention to provide a cable tautening means 28, the function of which is to hold the periphery of the enclosure 10 firmly in contact with the ground or base 12 thereby preventing escape of air from the inflated shelter. A cable tautening device 28 shown diagrammatically in FIG. 5 is secured to the base 12 or to a wall of a housing 48 by any suitable fastener means, such as a clamping device (not shown). One end of the cable 18 is secured to the tautening means 28 and the other end of the cable 18 is secured to another fastening means, such as an eyebolt or a hook 52 likewise affixed to the base 12 or to a wall of the housing 48. Thus the cable 18 extends in opposite directions from the two points of its attachment located adjacent the base 12.

The cable 18 follows the track of curvatures in flanges 34 in the corner anchors 22 while being held in place by the hooks 46 of the side anchors 24. The tautening means 28 stretches the cable 18 to a point that there is no slackness so that loss of air from the inflated enclosure 10 is virtually nil and the concentration of stress is substantially evenly distributed throughout the entire length of the cable 18 which runs along the surface of the base 12. Various cable tautening means which are suitable in the practice of this invention include a ratchet puller with safety hooks, a winch, a load binder connected to a turnbuckle and the like.

Figure 6:
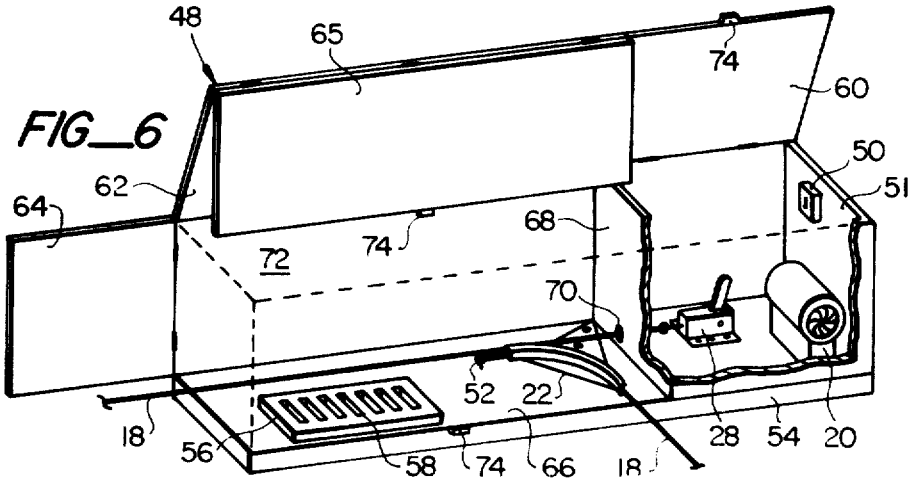
FIG. 6 is a perspective view of the housing of this invention indicating the location of various accessories therein when the housing is open for use in conjunction with the enclosure.

As pointed out earlier, it is a particular feature of this invention to provide a housing 48 which may optionally be included in the shelter system not only to store the deflated enclosure 10 but also to contain all the equipment and accessories required for erection of the shelter and for maintaining the shelter in inflated position. When a suitable housing is included in the system, the shelter together with all the auxiliary accessories may conveniently be placed therein for storage or shipping purposes. The housing 48 may be fabricated from a rigid, weather-resistant, water-resistant, durable, non-rotting material, such as a molded plastic, certain kinds of wood or fiberboard or plywood overlaid with a resin-treated cellulosic sheet. While the specific design of the housing 48 will depend on the size of the enclosure 10 and on the number and size of the accessories, the design illustrated in FIG. 6 is very satisfactory. It is adapted to contain the blower assembly including an intermittently operated blower 20 and the shutter means 56 interconnected therewith by an air-tight duct formed by a false bottom 54 in the housing 48, the cable tautening means 28, an air pressure control switch 50, a corner anchor 22 and sufficient storage space to accomodate the enclosure 10 in its collapsed form and folded over. The housing 48 is preferably located on the base 12 adjacent the bottom periphery of the enclosure 10 in such a manner that a portion of the enclosure 10 held by the corner anchor 22 traverses the housing with its small lid 60, large lid with hinged front wall 65 and one side wall 64 in open position. Accordingly, when the enclosure is inflated, the shutter means 56 constitutes the blower outlet and has flapping slats 58 which are in open position when the blower is operating and in closed position when the blower is inactive. The shutter means 56 is situated inside the enclosure 10 while all other auxiliary equipment is located outside the enclosure 10.

The blower 20 which forces air through the duct 54 and shutter means 56 into the interior of the enclosure 10 includes a fan and a motor (not shown) and is mounted on the bottom wall 66 of the housing 48 in a small compartment arranged by provision of a vertical inner partition wall 68 which separates it from a large compartment in which the shutter box 56 and a corner anchor 22 are mounted. A switch 50 mounted on the side wall 51 of the small compartment is connected to a power source and to the motor leads of the blower. The partition wall 68 is provided with a hole 70 adjacent the bottom edge thereof for the passage of the cable 18 which is positioned in the curved track 36 of corner anchor 22 affixed by any common fastener means to the floor 66 of the large compartment and interconnects with the tautening means 28. The rear wall 72 of the housing 48 is stationary and hingedly connects at the top with the lids 60 and 62 and with the side wall 64, as illustrated in FIG. 6. The front wall 65 is likewise hingedly secured to the lid 62.

As mentioned earlier, the enclosure 10 in its collapsed and folded state can be stored in the large compartment of the housing 48. Conventional locks 74 are suitably affixed to lid 60 and the front wall 65 with their registering locking parts affixed near the top edge of the front wall of the small compartment and the front of the false bottom wall, respectively.

It is within the scope of this invention to optionally provide an additional inflatable cover (not shown) for a swimming pool or the like, such cover being constructed, anchored and operable in substantially the same manner as the enclosure 10. When installed and maintained in its inflated position, the cover extends a short distance above the surface of water in the swimming pool and its top has a slightly convex configuration. The cover may be used primarily to shield the pool from leaves, debris, etc. when the enclosure 10 is dismantled and stored away. It will be understood, however, that to install such a cover a separate set of side and corner anchors with a corresponding number of openings in the deck and separate accessories including a cable tautening means, a blower assembly and a switch for the blower would be needed. It may also be necessary to provide a larger housing to insure adequate storage space for the cover and all the additional accessories.

To erect the shelter, the enclosure 10 is removed from the housing 48, then unfolded and spread over a swimming pool or any other area to be protected. The cable 18 extending in the hem 14 of the enclosure 10 is positioned in the tracks of corner anchors 22 which cause a change in the direction of the cable. The cable 18 is then tightened to a desired tension with the tautening means 28. All the side anchors 24 are inserted into the openings 26 in the base 12 and connected to cable 18 in a matter of minutes. The enclosure 10 is inflated by activating the control switch 50 connected to the blower 20 and inflation operation proceeds until the final contour of enclosure 10 is attained. Several experimental trials have shown that the inflating procedure usually requires less than 30 minutes for a swimming pool of 20×40 feet size. After the enclosure 10 has been erected, it maintains its curved shape by automatically controlled action of the blower assembly which supplies air under pressure into the area covered by enclosure 10.

It will be apparent from the foregoing description that I have devised an improved air-supported shelter system characterized by having a new combination of elements which are required for its operation. Such combination produces an easily and rapidly erectable inflated enclosure which can readily be dismantled manually and conveniently stored together with all the auxilliary equipment in a compact housing.

While the shelter system has been described herein primarily in conjunction with a swimming pool, the present invention is not restricted to such use alone but is applicable to cover other areas, such as tennis courts, agricultural areas, greenhouses, radar installations, recreation spots, as well as in warehousing, climate control, pouring of cement foundations and the like, thereby providing a comfortable environment protected from outside elements and cold.

It will be understood that various modifications in the forms of this invention as herein described may be made without departing from the spirit thereof or the scope of the claims which follow.

I claim:

1. An air-supported shelter system comprising in combination:

(a) an inflatable enclosure attached to a base along the periphery of said enclosure and having a relatively narrow integral hem at the lower portion thereof, the peripheral edge of said enclosure being adapted to be in air-sealing contact with said base;

(b) a cable extending within said hem;

(c) a blower assembly for inflating said enclosure and maintaining said enclosure in inflated form; said shelter system being characterized by having:

(d) an anchoring means attaching releasably said enclosure to said base, said anchoring means including a plurality of corner anchors each of said corner anchors comprising a rod slidably insertable into an opening in said base, a plate affixed to said rod at a substantially right angle thereto and an outwardly extending curved flange, said flange having a recess forming a track for receiving said cable, and side anchors slidably insertable into openings in said base; and (e) a cable tautening means for holding the periphery of said enclosure firmly in contact with said base, whereby loss of air from under said enclosure is substantially prevented.

2. The shelter system of claim 1 wherein said inflatable enclosure is formed of a lightweight, flexible, water-repellent and substantially air-tight sheet material.

3. The shelter system of claim 1 wherein said flange comprises an upper lip and a lower lip, said upper lip being covered with a protective strip of a resilient material.

4. The shelter system of claim 1 wherein each of said side anchors is substantially L-shaped and includes a rod slidably insertable into an opening in said base and an arm, the free end of said arm being of a hook-like configuration to receive and hold said cable.

5. The shelter system of claim 1 including a housing for containing said blower assembly, an air-pressure control switch, said cable tautening means and one of said corner anchors, said housing having sufficient storage space to accomodate said inflatable enclosure in its collapsed state.

6. The shelter system of claim 5 wherein one end of said cable is secured within said housing, the other end of said cable being secured of said tautening means.

7. The shelter system of claim 5 wherein said housing comprises a false bottom consituting an air-tight duct in said blower assembly.

8. The shelter system of claim 7 wherein said blower assembly includes an intermittently operated blower means mounted and operated within one end of said housing, a shutter means mounted at the opposite end of said housing, said blower means and said shutter means being interconnected by said air-tight duct and wherein a portion of said enclosure traverses said housing sothat the blower means is situated outside said enclosure and said shutter means is situated within said enclosure.

9. The shelter system of claim 1 wherein said system further includes an inflatable cover to be disposed over a swimming pool or the like, said cover being constructed, anchored and operable in substantially the same manner as said enclosure and extending a short distance above the surface of water in said swimming pool when in inflated position.

* * * * *